US011806306B1

(12) United States Patent
Guo

(10) Patent No.: US 11,806,306 B1
(45) Date of Patent: Nov. 7, 2023

(54) SURROUND PINCH-KNEADING MASSAGER

(71) Applicant: Xuebin Guo, Changde (CN)

(72) Inventor: Xuebin Guo, Changde (CN)

( * ) Notice: Subject to any disclaimer, the term of this patent is extended or adjusted under 35 U.S.C. 154(b) by 0 days.

(21) Appl. No.: 18/219,668

(22) Filed: Jul. 8, 2023

(30) Foreign Application Priority Data

Mar. 1, 2023 (CN) ..... 202320351460.3

(51) Int. Cl.
*A61H 7/00* (2006.01)
*A61H 15/00* (2006.01)

(52) U.S. Cl.
CPC ..... *A61H 7/008* (2013.01); *A61H 15/0085* (2013.01); *A61H 2015/0042* (2013.01)

(58) Field of Classification Search
CPC ..... A61H 19/00; A61H 19/30; A61H 19/32; A61H 19/34
See application file for complete search history.

(56) References Cited

U.S. PATENT DOCUMENTS 816,748 A * 4/1906 Saighman ..... A61H 9/005 601/7
2,076,410 A * 4/1937 Mcgerry ..... A61H 9/005 601/7
3,374,784 A * 3/1968 Brent ..... A61H 7/004 601/94
3,536,064 A * 10/1970 Ochi ..... A61H 23/0254 601/93
4,414,963 A * 11/1983 Kunz ..... A61H 7/004 601/134
4,526,163 A * 7/1985 Fedders ..... A61H 7/004 601/112
4,920,957 A * 5/1990 Sutherland ..... A61H 7/005 601/133
5,458,559 A * 10/1995 Gauntlett ..... A61H 19/32 600/38
5,569,168 A * 10/1996 Hartwig ..... A61H 7/005 601/103
6,190,339 B1 * 2/2001 Imazaike ..... A61H 7/005 601/135
6,440,091 B1 * 8/2002 Hirosawa ..... A61H 7/00 601/93
6,629,940 B2 * 10/2003 Shimizu ..... A61H 7/00 601/97
6,923,755 B2 * 8/2005 Norma ..... A61H 19/50 600/38
6,949,067 B1 * 9/2005 Dann ..... A61H 19/34 600/38

(Continued)

*Primary Examiner* — LaToya M Louis
(74) *Attorney, Agent, or Firm* — Georgi Korobanov

(57) ABSTRACT

The present application discloses a surround pinch-kneading massager, comprising a housing and a massage drive mechanism, wherein a surface of the housing protrudes outward to form a soft bell-shaped cap, and the massage drive mechanism is arranged in the housing, wherein the massage drive mechanism is respectively drivingly connected to two opposite side walls of the bell-shaped cap, so that the massage drive mechanism drives the two opposite side walls of the bell-shaped cap to reciprocate and swing close to or away from each other to generate a pinch-kneading massage action, thereby enriching the massage methods of the massager and expanding the use range of the massager, so as to meet the diverse choices of users, thereby enhancing the user's sense of experience.

11 Claims, 12 Drawing Sheets

(56) References Cited

U.S. PATENT DOCUMENTS 7,083,582 B2 * 8/2006 Chen ..... A61H 15/0078 601/102
7,108,669 B2 * 9/2006 Huang ..... A61H 7/004 601/134
7,108,670 B2 * 9/2006 Huang ..... A61H 7/004 601/134
7,147,611 B2 * 12/2006 Kassel ..... A61H 23/0254 601/93
7,153,282 B1 * 12/2006 Dudley ..... A61H 7/004 601/93
8,105,253 B2 * 1/2012 Chen ..... A61H 7/004 601/134
8,579,837 B1 * 11/2013 Makower ..... A61H 23/0263 601/6
8,647,255 B2 * 2/2014 Levy ..... A61F 5/41 600/38
8,734,321 B1 * 5/2014 Weller ..... A61H 19/30 600/38
8,974,471 B2 * 3/2015 Fuerst ..... A61H 23/02 606/118
8,992,450 B1 * 3/2015 Heilman ..... A61H 33/6057 4/615
9,138,373 B2 * 9/2015 Caropelo ..... A61H 19/30
10,123,933 B2 * 11/2018 Shao ..... A61H 19/32
10,426,693 B2 * 10/2019 Ishikawa ..... A61H 7/007
11,007,110 B1 * 5/2021 Zhou ..... A61H 23/0263
11,090,220 B2 * 8/2021 Lenke ..... A61H 19/00
11,103,418 B2 * 8/2021 Lenke ..... A61H 23/0263
11,129,767 B1 * 9/2021 Haddock DiCarlo . A61H 19/34
11,185,463 B2 * 11/2021 Haddock DiCarlo . A61H 9/005
11,317,961 B2 * 5/2022 Luzon ..... A61B 18/14
11,491,075 B2 * 11/2022 Fuster ..... A61H 7/004
11,554,073 B1 * 1/2023 Guo ..... A61H 7/005
11,730,958 B2 * 8/2023 Druke ..... A61N 1/36021 607/46
2001/0041851 A1 * 11/2001 Peyton ..... A61H 39/04 601/134
2003/0199796 A1 * 10/2003 Yamazaki ..... A61H 7/007 601/134
2006/0069328 A1 * 3/2006 Huang ..... A61H 7/004 601/134
2006/0074358 A1 * 4/2006 Hsieh ..... A61H 7/001 601/90
2007/0021694 A1 * 1/2007 Shiraishi ..... A61H 7/001 601/134
2007/0255188 A1 * 11/2007 Tseng ..... A61H 7/007 601/93
2009/0118573 A1 * 5/2009 Tsao ..... A61F 5/41 600/38
2009/0118652 A1 * 5/2009 Carlucci ..... A61H 7/007 601/134
2010/0286577 A1 11/2010 Tsai
2011/0257473 A1 * 10/2011 Torla ..... A61H 19/50 600/38
2013/0178764 A1 * 7/2013 Eckhouse ..... A61N 5/0613 601/2
2014/0188017 A1 * 7/2014 Wu ..... A61H 23/02 601/46
2015/0045706 A1 * 2/2015 Asfora ..... A61H 23/0263 601/46
2015/0065792 A1 * 3/2015 Levine ..... A61H 19/32 600/38
2015/0133833 A1 * 5/2015 Bradley ..... A61H 23/0263 601/18
2016/0151236 A1 * 6/2016 Makower ..... A61H 19/50 601/48
2017/0105896 A1 * 4/2017 Derwin ..... A61H 19/34
2017/0252261 A1 * 9/2017 Khorassani Zadeh ..... A61H 9/0057
2018/0185237 A1 * 7/2018 Baetica ..... G08C 17/02
2018/0228690 A1 * 8/2018 Hirsch ..... A61H 19/32
2022/0015983 A1 * 1/2022 Li ..... A61H 23/0218
2022/0168179 A1 * 6/2022 Peck ..... A61H 7/003

* cited by examiner

SURROUND PINCH-KNEADING MASSAGER

CROSS-REFERENCE TO RELATED APPLICATIONS

This application claims the benefit and priority of Chinese patent application No. 202320351460.3, filed on Mar. 1, 2023, disclosure of which is hereby incorporated by reference in its entirety.

TECHNICAL FIELD

The present application discloses a surround pinch-kneading massager, in particular to a surround pinch-kneading massager.

BACKGROUND

Massage equipment is used to massage and relax the human body through mechanical or electrical stimulation. When the muscles feel sore and tense due to fatigue, the use of massage equipment can stimulate the nerves, relax the tendons, improve blood circulation, and relax the tense muscles after exercise, thereby effectively reducing the fatigue and soreness caused by exercise and mental stress. Massage equipment is generally designed according to the massage techniques of human hands, so as to achieve or even exceed the effect of human massage. Common massage techniques include pressing, pinching, rubbing, kneading, pushing, holding, clapping, shaking, and vibrating.

For small hand-held massagers, due to its design requirement of simple and light structure, there are not many massage methods for small hand-held massagers on the market, and there are still many types of massage methods to be developed. Existing small hand-held massagers generally vibrate and massage the human body through motor vibration or left and right swings, and the massage method is relatively simple. At present, there is no massager that can realize the pinch-kneading massage action, which cannot satisfy the diverse choices of users. In many cases, because the massager cannot achieve the corresponding massage action, it can only be massaged by hand, which leads to the limited range of use of the massager and makes the customer's use experience poor.

SUMMARY

The purpose of the present application is to provide a surround pinch-kneading massager, aiming to solve the technical problem that the massager in the prior art cannot realize the pinch-kneading massage action.

In order to achieve the above purpose, the technical solution of the present application provides a surround pinch-kneading massager, comprising:

a housing, the housing comprises soft bell-shaped cap; and a massage drive mechanism, the massage drive mechanism comprises a first clipping arm, a second clipping arm and a driving component, a first end of the first clipping arm and a first end of the second clipping arm are respectively connected to two opposite side walls of the bell-shaped cap, the driving component is arranged in the housing, and the driving component is respectively drivingly connected to a second end of the first clipping arm and a second end of the second clipping arm, so that the first end of the first clipping arm and the first end of the second clipping arm are driven by the driving component to move toward or away from each other, so that the two opposite side walls of the bell-shaped cap produce a pinch-kneading massage action.

Further, the first clipping arm is pivotally connected with the housing, and the second clipping arm is pivotally connected with the housing, so as to drive the first end of the first clipping arm and the first end of the second clipping arm to reciprocate and swing close to or away from each other by the driving component.

Further, the bell-shaped cap protrudes outward from one end of the housing.

Further, the surround pinch-kneading massager further comprises an air suction component, the air suction component comprises an air pump, the air pump communicates with an inner chamber of the bell-shaped cap through an air pipe, and the air pipe is provided with an airflow control valve.

Further, the first end of the first clipping arm and the first end of the second clipping arm are respectively inserted into the opposite side walls of the bell-shaped cap, and the side walls of the bell-shaped cap substantially covers the first end of the first clipping arm and the first end of the second clipping arm.

Further, the driving component comprises:

a rotating wheel set, a rotating axis of the rotating wheel set is configured to be perpendicular to a swing axis of the first clipping arm, the swing axis of the first clipping arm is arranged parallel to the swing axis of the second clipping arm, and the rotating wheel set comprises a first cam joint and a second cam joint;

a driving part, the driving part is configured to drive the rotating wheel set to rotate;

a first conversion part, by a cooperation between the first conversion part and the first cam joint, a rotary motion of the rotating wheel set is converted into a reciprocating-swinging motion of the first clipping arm around its swing axis; and a second conversion part, through a cooperation between the second conversion part and the second cam joint, the rotary motion of the rotating wheel set is converted into a reciprocating-swinging motion of the second clipping arm around its swing axis, so that the second clipping arm and the first clipping arm perform reciprocating-swinging motion in a manner of approaching or moving away from each other.

Further, the first cam joint comprises:

a first cam wheel, the first cam wheel is arranged eccentrically with respect to a rotation axis of the rotating wheel set, and a first cam surface is formed on an outer peripheral surface of the first cam wheel;

the second cam joint comprises:

a second cam wheel, the second cam wheel is eccentrically stacked on the first cam wheel relative to the rotation axis of the rotating wheel set, and a second cam surface is formed on an outer peripheral surface of the second cam wheel;

the first conversion part comprises:

a first sliding part, the first sliding part comprises a first annular hole, and the first sliding part is movably fitted with the first cam surface of the first cam wheel by the first annular hole; and a first conversion connecting part, the first conversion connecting part is connected between the first sliding part and the second end of the first clipping arm, so that a moving motion of the first sliding part is converted into the reciprocating-swinging motion of the first clipping arm around its swing axis by the first converting connecting part;

the second conversion part comprise:

a second sliding part, the second sliding part comprises a second annular hole, and the second sliding part is movably fitted with the second cam surface of the second cam wheel by the second annular hole; and a second conversion connecting part, the second conversion connecting part is connected between the second sliding part and the second end of the second clipping arm, so that a moving motion of the second sliding part is converted into the reciprocating-swinging motion of the second clipping arm around its swing axis by the second converting connecting part, and a guiding structure, configured to guide the first sliding part and the second sliding part to move respectively along a movement path perpendicular to the swing axis by the guiding structure when the rotating wheel set is rotating, and, at the same time, moving directions of the first sliding part and the second sliding part are opposite, so that the first end of the first clipping arm and the first end of the second clipping arm perform reciprocating-swinging motions in a manner of approaching or moving away from each other.

Further, the first conversion connecting part comprises:

a first shaft, the first shaft is arranged on a left side of the first sliding part, and a central axis of the first shaft extends parallel to the swing axis of the first clipping arm; and a first swing arm clamping slot, the first swing arm clamping slot is arranged at the second end of the first clipping arm, and the first swing arm clamping slot is movably snapped on the first shaft;

the second conversion connecting part comprises:

a second shaft, the second shaft is arranged on a left side of the second sliding part, and a central axis of the second shaft extends parallel to the swing axis of the second clipping arm; and a second swing arm clamping slot, the second swing arm clamping slot is arranged at the second end of the second clipping arm, and the second swing arm clamping slot is movably snapped on the second shaft.

Further, the guiding structure comprises:

a fixing seat, the fixing seat extends along a direction perpendicular to the swing axis of the first clipping arm to form a guiding groove;

a first slider, the first slider is arranged at an end of the first sliding part, and the first slider is slidably arranged in the guiding groove, so as to guide the first sliding part to move along a movement path perpendicular to the swing axis of the first clipping arm by sliding the first slider along an extending direction of the guiding groove; and a second slider, the second slider is arranged at an end of the second sliding part, and the second slider is slidably arranged in the guiding groove, so as to guide the second sliding part to move along a movement path perpendicular to the swing axis of the second clipping arm by sliding the second slider along the extending direction of the guiding groove.

Further, the surround pinch-kneading massager further comprises a surround massage component, the surround massage component comprises:

a motor, the motor is arranged in the housing, and the housing comprises an annular movement chamber, an eccentric wheel, the eccentric wheel comprises a first portion and a second portion opposite to each other, the first portion of the eccentric wheel comprises a hinged ball head, and the hinged ball head is arranged eccentrically with respect to a rotation axis of the eccentric wheel, the second portion of the eccentric wheel is drivingly connected with the motor, so that the eccentric wheel is driven to rotate by the motor; and a massage rod component, a first end of the massage rod component extends outward from one end of the housing to form a massage head, the bell-shaped cap surrounds the massage head, and a second end of the massage rod component comprises a mouth part, the hinged ball head can be movably fitted in the mouth part, and an outer peripheral surface of the massage bar component extends in a circumferential direction to form a protruding spherical surface, and the spherical surface can be movably fitted in the annular movement chamber.

Further, the housing is provided with a bracket, the annular movement chamber is arranged on the bracket, an inner peripheral surface of the annular movement chamber extends along a circumferential direction to form a concave annular spherical surface and forms through openings at its upper and lower ends, so that the first end and the second end of the massage rod component respectively pass through the through openings at two ends of the annular movement chamber.

Further, a diameter of the annular spherical surface is larger than a diameter of the spherical surface, and a height of the spherical surface along a axial direction is greater than a height of the annular spherical surface along the axial direction.

Further, the massage head is covered with a soft massage protrusion, and the bell-shaped cap surrounds the soft massaging protrusion to form an integral structure.

Further, a vibration motor is arranged in the soft massage protrusion.

Further, an upper end of the spherical surface extends axially to form an accommodating cavity, one end of the vibration motor is accommodated in the accommodating cavity, and other end of the vibration motor is inserted into the soft massage protrusion, and the soft massage protrusion basically covers the other end of the vibration motor.

Further, the soft massage protrusion is formed into a tongue-shaped structure or a finger-shaped structure.

It can be seen from the above technical solutions that, in the surround pinch-kneading massager of the present application, a soft bell-shaped cap is formed at one end of the housing, wherein the bell-shaped cap closely fits the massaged parts of the human body. The massage drive mechanism in the housing is connected to the opposite side walls of the bell-shaped cap respectively, so that the massage drive mechanism drives the opposite side walls of the bell-shaped cap to move towards or away from each other. In this way, the opposite side walls of the bell-shaped cap can pinch and knead the massage parts of the human body, thereby enriching the massage methods of the massager and expanding the range of use of the massager to meet the diverse choices of users, thereby improving the user experience.

In order to make the technical conception and other purposes, advantages, features and functions of the present application clearer and easier to understand, preferred embodiments will be given in the detailed description below, together with the accompanying drawings, for a detailed description.

DETAILED DESCRIPTION

Figure 1:
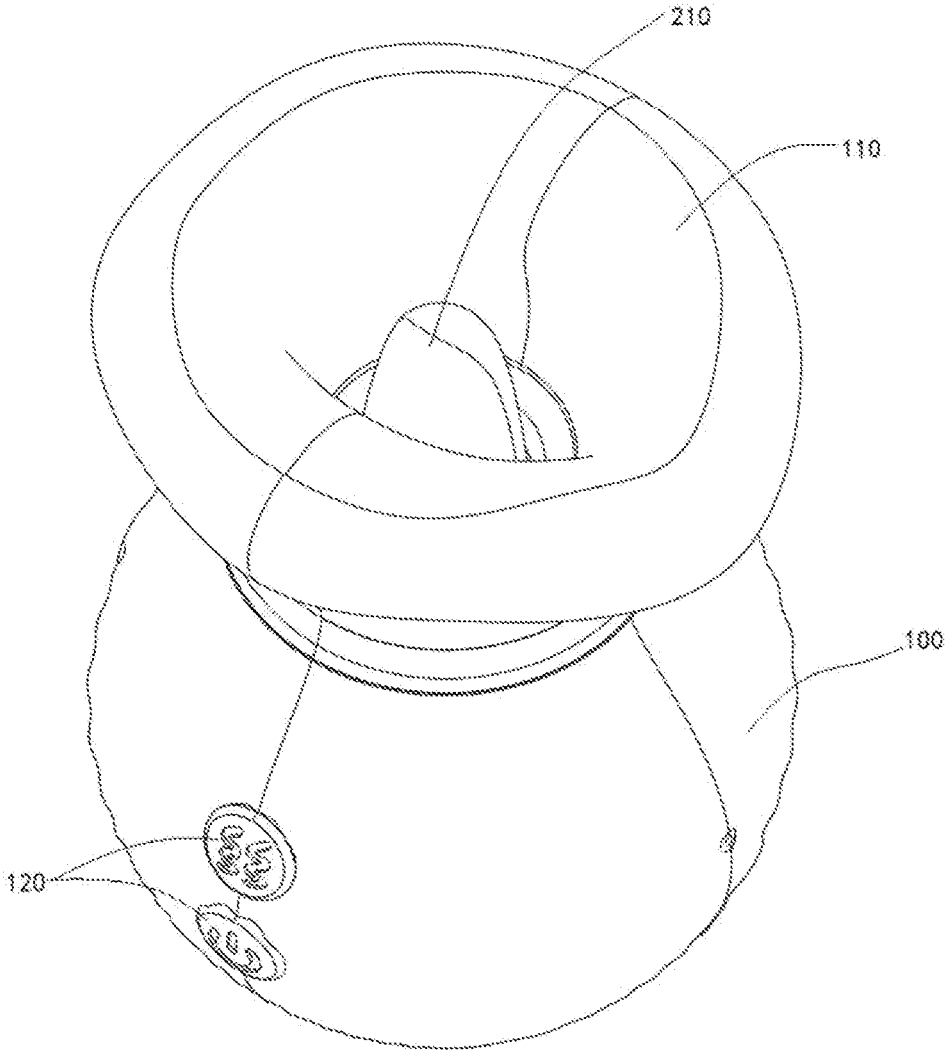
FIG. 1 is a structural schematic diagram of a surround pinch-kneading massager provided by an embodiment of the present application at a first viewing angle.
Figure 2:
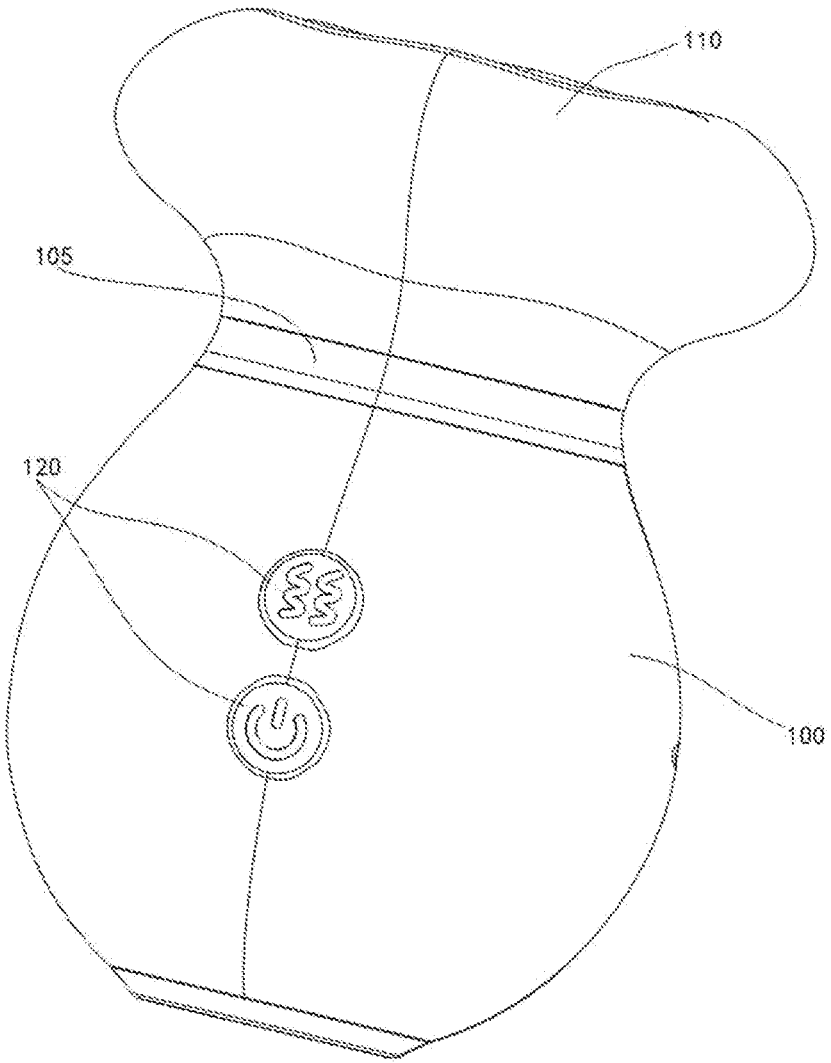
FIG. 2 is a structural schematic diagram of a surround pinch-kneading massager provided by an embodiment of the present application at a second viewing angle.

The embodiment of the present application provides a surround pinch-kneading massager to solve the technical problem that the small and medium-sized hand-held massagers in the prior art cannot realize the pinch-kneading massage action. A soft bell-shaped cap 110 protrudes outward from one end of the housing 100, and the massage drive mechanism 400 in the housing 100 is respectively drivingly connected to the opposite sides of the bell-shaped cap 110, so that the massage drive mechanism 400 drives the opposite side walls of the bell cap 110 to reciprocate in a manner of approaching or moving away from each other to generate a pinch-kneading massage action.

In order to enable those skilled in the art to better understand the technical solutions of the present application, the technical solutions in the embodiments of the present application will be clearly and completely described below in conjunction with the drawings in the embodiments of the present application. Apparently, the described embodiments are only some of the embodiments of the present application, rather than all the embodiments. Based on the embodiments in this application, all other embodiments obtained by those skilled in the art without making creative efforts belong to the protection scope of this application.

Please refer to FIG. 1 to FIG. 12 together, this embodiment provides a surround pinch-kneading massager, comprising a housing 100 and a massage drive mechanism 400, wherein a surface of the housing 100 protrudes outward to form a soft bell-shaped cap 110, and the massage drive mechanism 400 is arranged in the housing 100, wherein the massage drive mechanism 400 is respectively drivingly connected to two opposite side walls of the bell-shaped cap 110, so that the massage drive mechanism 400 drives the two opposite side walls of the bell-shaped cap 110 to reciprocate and swing close to or away from each other to generate a pinch-kneading massage action.

It can be seen from the above technical solutions that, in the surround pinch-kneading massager of the present application, a soft bell-shaped cap 110 is formed at one end of the housing 100, wherein the bell-shaped cap 110 closely fits the massaged parts of the human body. The massage drive mechanism 400 in the housing 100 is connected to the opposite side walls of the bell-shaped cap 110 respectively, so that the massage drive mechanism 400 drives the opposite side walls of the bell-shaped cap 110 to move towards or away from each other. In this way, the opposite side walls of the bell-shaped cap can pinch and knead the massage parts of the human body, thereby enriching the massage methods of the massager and expanding the range of use of the massager to meet the diverse choices of users, thereby improving the user experience.

As shown in FIGS. 1 to 4, the housing 100 of the surround pinch-kneading massager mainly comprises a left housing 101, a right housing 102, a silicone soft cover 103, a bottom cover 104, a pressure ring 105 and a fixing seat 510. The fixing base 510 comprises a base 520 and an upper cover 530. The massage drive mechanism 400 and the fixing seat 510 are combined to form the movement of the massager, and the movement is enclosed by the mutual fastening of the left housing 101 and the right housing 102. The bottom cover 104 is installed on the bottom of the left housing 101 and the right housing 102, and the silicone soft cover 103 is arranged on the outside of the left housing 101 and the right housing 102. The edge of the bell-shaped cap 110 is fixedly arranged on the top of the left housing 101 and the right housing 102 through a pressure ring 105, so as to achieve the effect of sealing, waterproof and moisture-proof. The bell-shaped cap 110 is made of silica gel or rubber. The port of the soft bell-shaped cap 110 contacts the skin of the massaged part of the body more softly and closely, which can effectively avoid accidentally scratching the skin of the body. The soft bell-shaped cap 110 presses and fits tightly with the skin of the massaged part of the human body, and the port of the soft bell-shaped cap 110 is covered on the skin of the human body part, so that the massage drive mechanism 400 can drive the opposite sides of the bell-shaped cap 110 to reciprocate and swing in a manner of approaching or moving away from each other, so as to realize the pinching or kneading massage action on the massage parts of the human body. Preferably, the bell-shaped cap 110 can be made of transparent soft silicone or rubber. The shape of the bell-shaped cap 110 can be adaptively adjusted according to massaging different human body parts. The left housing 101 and right housing 102 preferably are hard housings made of plastic materials. The left housing 101 and right housing 102 are correspondingly provided with a plurality of stud holes, so that the left housing 101 and right housing 102 can be detachably assembled by screws. The circuit board 130 and the rechargeable battery 140 are correspondingly installed in the space enclosed by the left housing 101 and right housing 102. The rechargeable battery 140 is preferably a lithium battery. A charging connector 150 is arranged outside the housing 100, and the charging connector 150 is electrically connected to the rechargeable battery 140, so as to supply power to the massager through the rechargeable battery 140. The circuit board 130 controls the massager to perform a massage action. A switch button 120 is arranged on the outside of the housing 100, and the keys on the circuit board 130 are arranged corresponding to the switch button 120.

Figure 11:
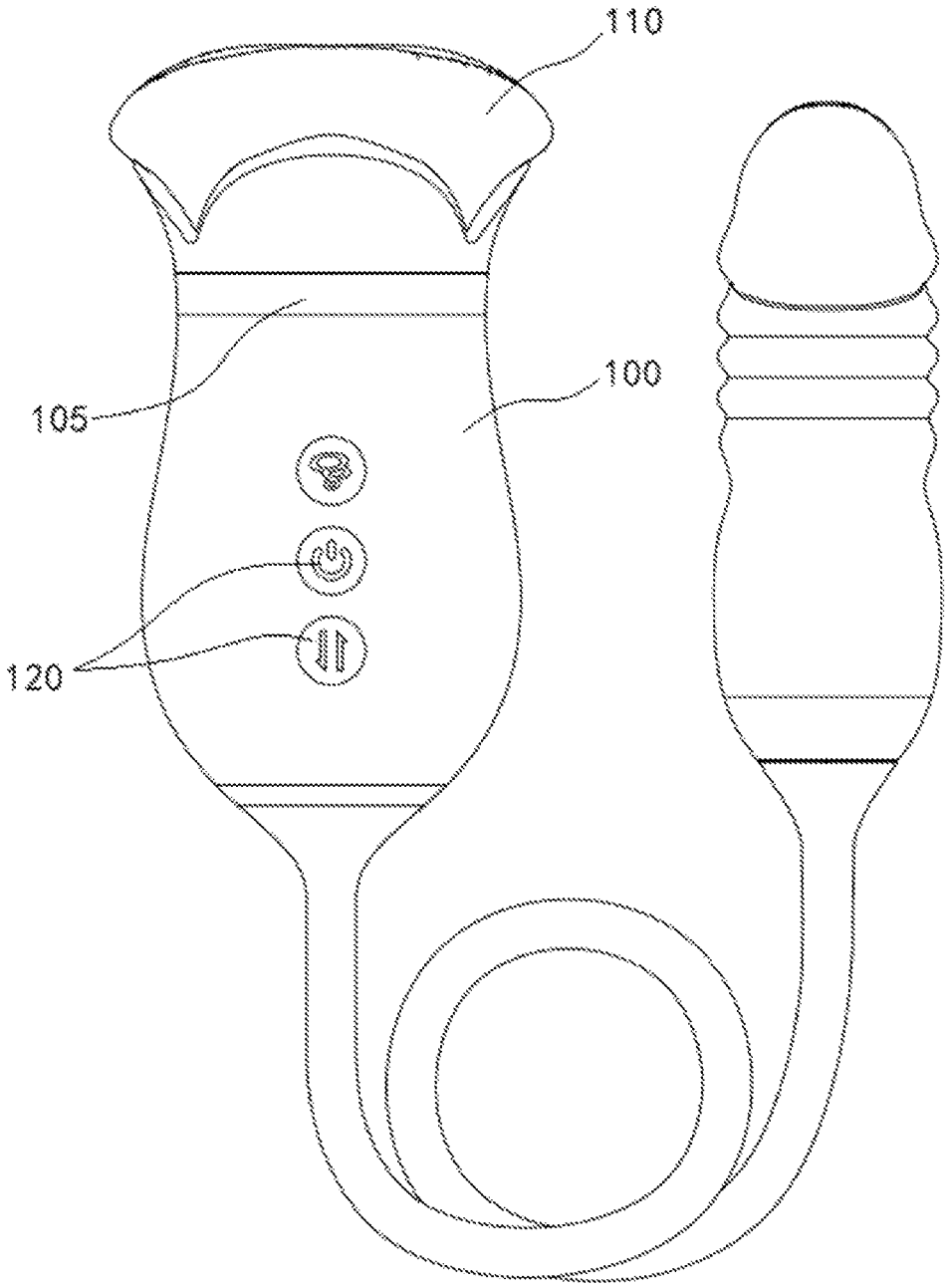
FIG. 11 is a schematic structural diagram of another embodiment of a surround pinch-kneading massager provided by an embodiment of the present application.
Figure 12:
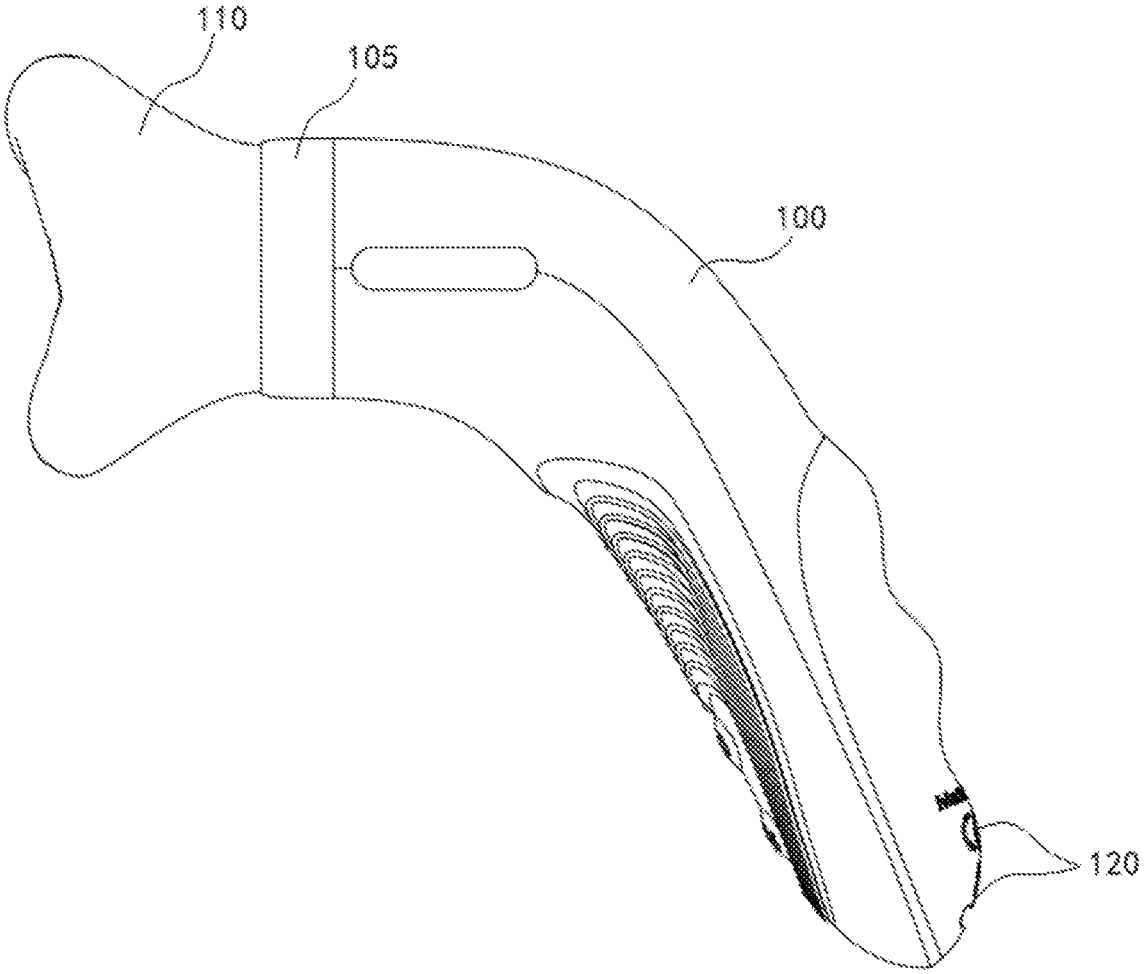
FIG. 12 is a schematic structural diagram of another embodiment of a surround pinch-kneading massager provided by an embodiment of the present application.

It should be noted that, as shown in FIG. 1, FIG. 11 and FIG. 12, the appearance shape of the housing 100 and/or the bell-shaped cap 110 can be designed and changed according to the actual situation. Therefore, the appearance shape of the housing 100 and/or the bell-shaped cap 110 is not limited to this.

Figure 3:
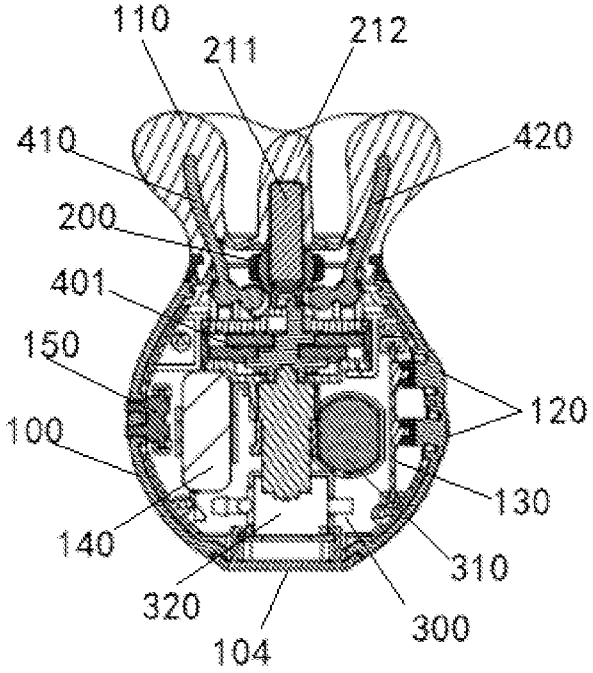
FIG. 3 is a cross-sectional view of a surround pinch-kneading massager provided by an embodiment of the present application at a first viewing angle.
Figure 4:
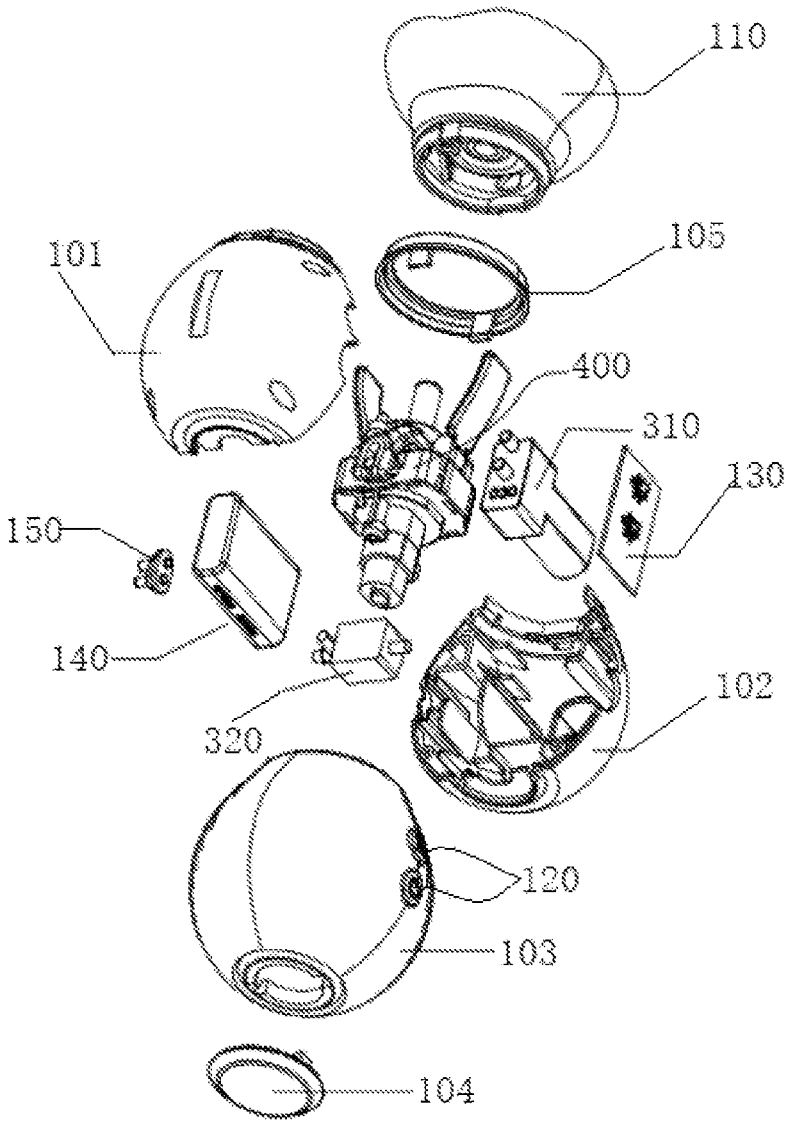
FIG. 4 is an exploded view of a surround pinch-kneading massager provided by an embodiment of the present application.
Figure 5:
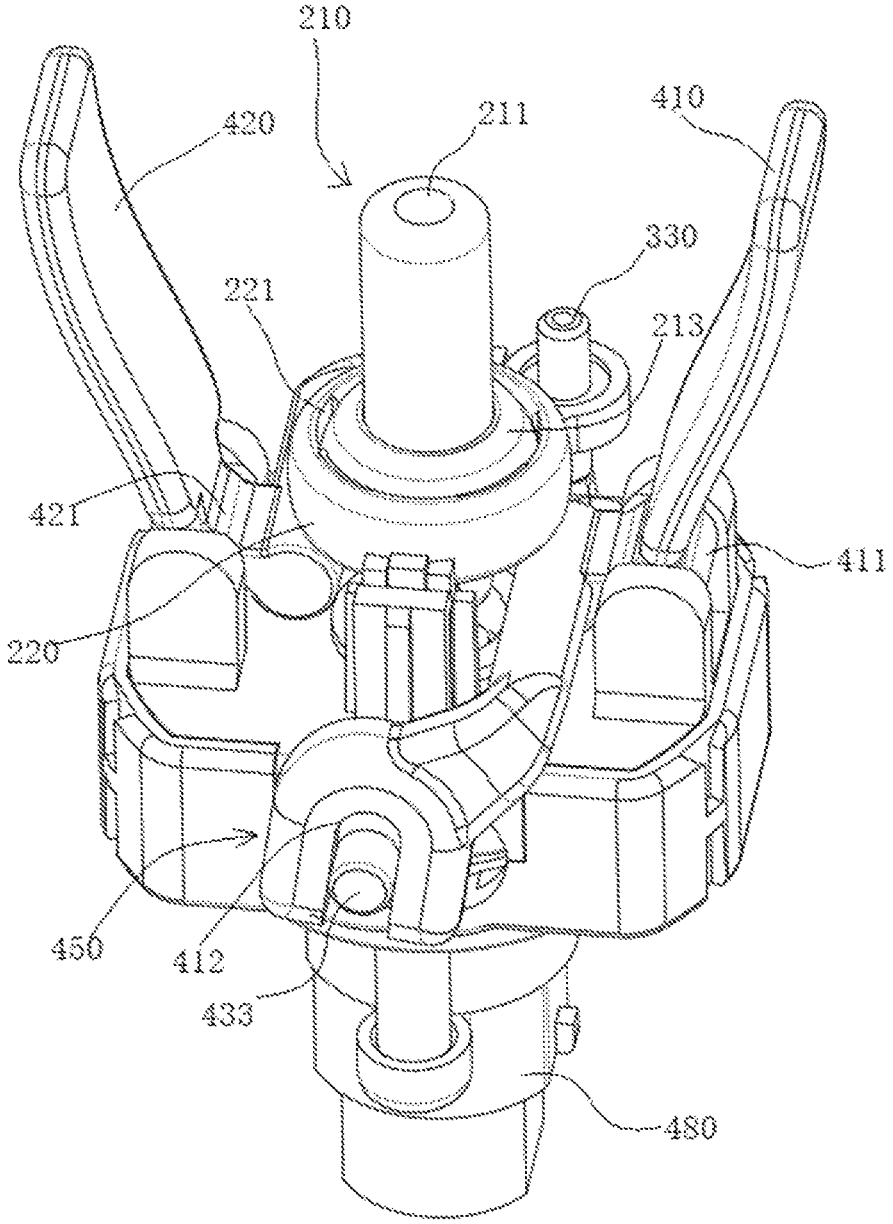
FIG. 5 is a structural schematic diagram of a massage drive mechanism provided by an embodiment of the present application at a first viewing angle.

In this embodiment, as shown in FIG. 3 and FIG. 4, the massage drive mechanism 400 comprises a first clipping arm 410, a second clipping arm 420 and a driving component 401, the first clipping arm 410 is pivotally connected to the housing 100, and the second clipping arm 420 is pivotally connected to the housing 100. The first end of the second clipping arm 420 and the first end of the first clipping arm are respectively connected to opposite side walls of the bell-shaped housing 110. The driving component 401 is arranged in the housing 100, and the driving component 401 is respectively drivingly connected to a second end of the first clipping arm 410 and a second end of the second clipping arm 420, so that the first end of the first clipping arm 410 and the first end of the second clipping arm 420 are driven by the driving component 401 to move toward or away from each other, so that the two opposite side walls of the bell-shaped cap 101 produce a pinch-kneading massage action.

As shown in FIGS. 5 to 9, the first end of the first clipping arm 410 and the first end of the second clipping arm 420 are generally plate-shaped structures. The first end of the first clipping arm 410 and the first end of the second clipping arm 420 are respectively built into opposite sides of the bell-shaped cap 110 in a one-to-one correspondence. Both sides of the first clipping arm 410 extend outward to form a first pivot shaft 411, and both sides of the second clipping arm 420 extend outward to form a second pivot shaft 421. The upper cover 530 of the fixing seat 510 is provided with a pair of first pivot grooves 531 and a pair of second pivot grooves 532, and the first pivot grooves 531 and the second pivot grooves 532 are respectively arranged on two opposite side edges of the upper cover 530 of the fixing base 510. The first clipping arm 410 is rotatably fitted in a pair of first pivot grooves 531 by the two ends of the first pivot shaft 411 respectively, so as to be pivotally connected with the housing 100, and the second clipping arm 420 is rotatably fitted in a pair of second pivot grooves 532 by the two ends of the second pivot shaft 421 respectively, so as to be pivotally connected with the housing 100. In this way, the first end of the first clipping arm 410 and the first end of the second clipping arm 420 can be driven by the driving component 401 to respectively drive the opposite sides of the bell-shaped cap 110 to reciprocate in a manner of approaching or moving away from each other, so as to realize the pinching or kneading massage action on the massaged part at the port of the bell-shaped cap 110.

Specifically, as shown in FIGS. 5 to 9, the driving component 401 comprises a rotating wheel set 470, a driving part 480, a first conversion part 430 and a second conversion part 440. A rotating axis of the rotating wheel set 470 is configured to be perpendicular to a swing axis of the first clipping arm 410, the swing axis of the first clipping arm 410 is arranged parallel to the swing axis of the second clipping arm 420, and the rotating wheel set 470 comprises a first cam joint and a second cam joint; the driving part 480 is configured to drive the rotating wheel set 470 to rotate; a rotary motion of the rotating wheel set 470 is converted into a reciprocating-swinging motion of the first clipping arm 410 around its swing axis by a cooperation between the first conversion part 430 and the first cam joint; the rotary motion of the rotating wheel set 470 is converted into a reciprocating-swinging motion of the second clipping arm 420 around its swing axis by a cooperation between the second conversion part 440 and the second cam joint, so that the second clipping arm 420 and the first clipping arm 410 perform reciprocating-swinging motion in a manner of approaching or moving away from each other.

Figure 8:
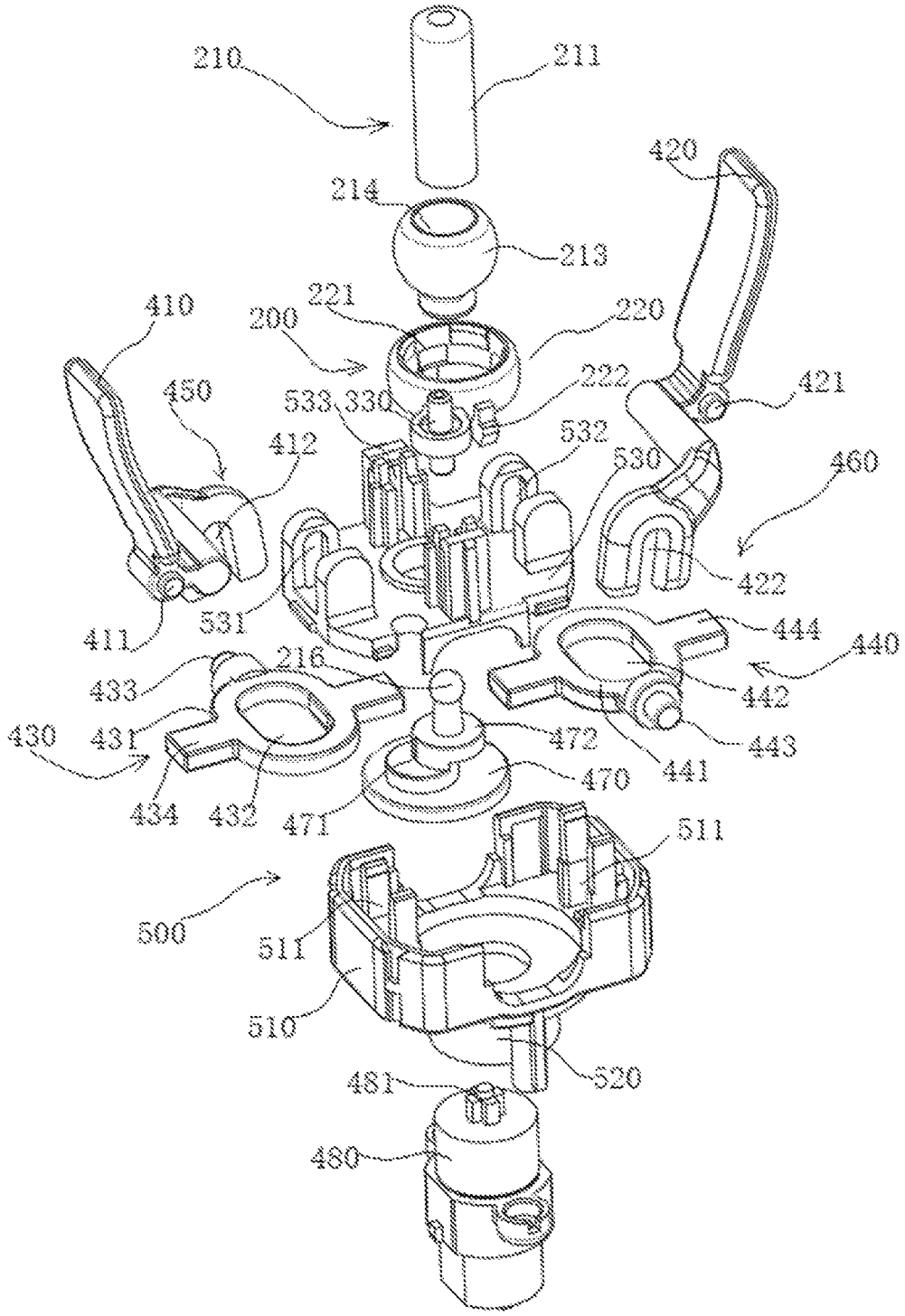
FIG. 8 is an exploded view of a massage drive mechanism provided by an embodiment of the present application at a first viewing angle.
Figure 9:
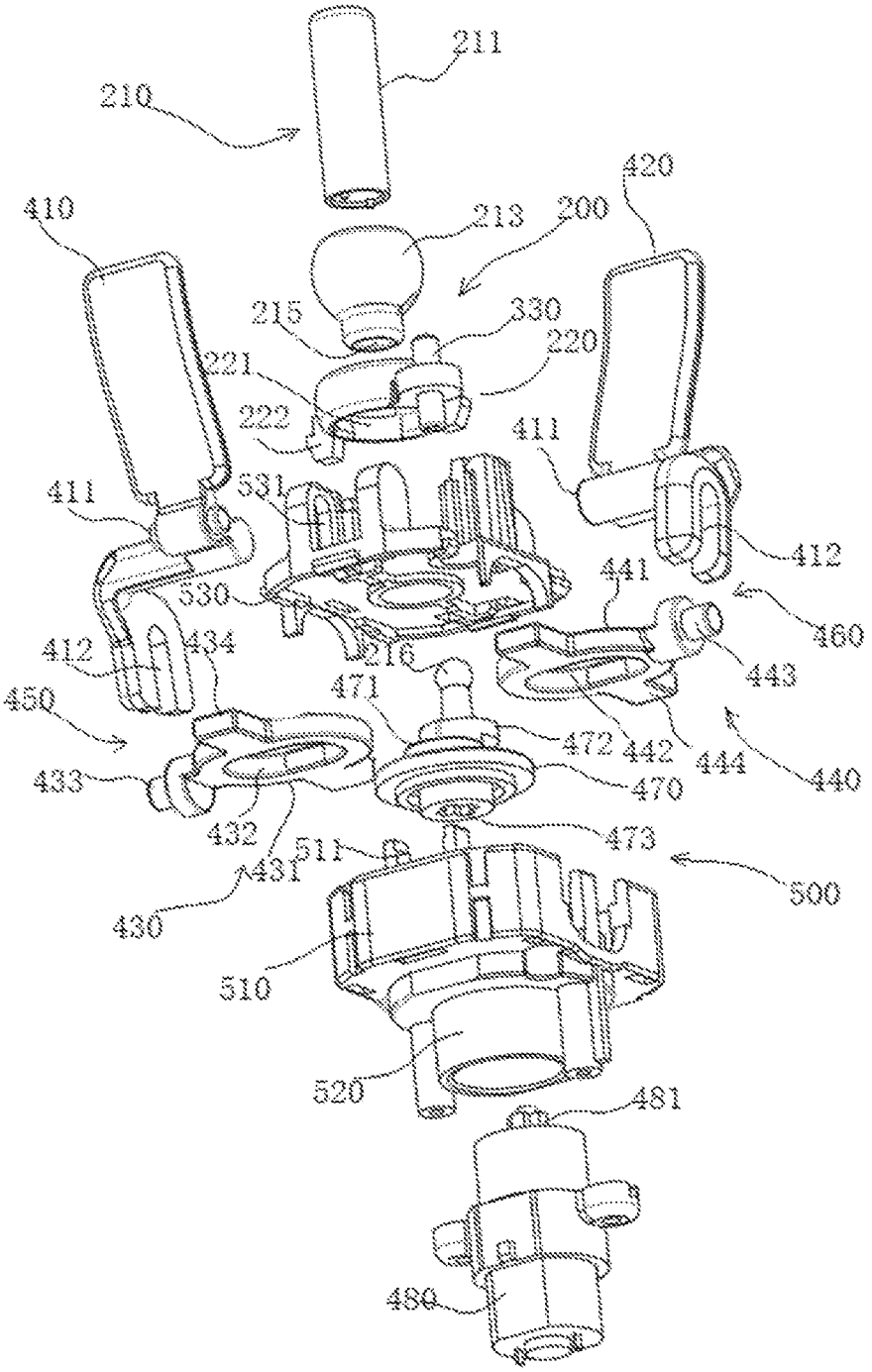
FIG. 9 is an exploded view of a massage drive mechanism provided by an embodiment of the present application at a second viewing angle.

As shown in FIGS. 8 and 9, a cross-shaped installation groove 473 is provided at the bottom of the rotating wheel set 470, the driving part 480 is a motor, and the output shaft 481 of the motor is cross-shaped to play the role of circumferential positioning. The output shaft 481 of the driving part 480 is inserted into the installation groove 473 of the rotating wheel set 470. The driving part 480 is installed under the base 520 of the fixing seat 510, and the rotating wheel set 470 is located in the fixing seat 510 to drive the rotating wheel set 470 to rotate through the driving part 480, and then the rotational force of the rotating wheel set 470 is transmitted to the first conversion part 430 and the second conversion part 440 through the first cam joint and the second cam joint respectively, so that the first conversion part 430 and the second conversion part 440 respectively push and pull the second end of the first clipping arm 410 and the second end of the second clipping arm 420, so as to drive the first end of the first clipping arm 410 and the first end of the second clipping arm 420 to reciprocate and swing in a manner of approaching or moving away from each other, thereby driving the two opposite side walls of the bell-shaped cap 110 to produce a pinching or kneading massage action.

Further, as shown in FIGS. 8 and 9, a first cam wheel 471 is arranged at the first cam joint, and the first cam wheel 471 is arranged eccentrically with respect to a rotation axis of the rotating wheel set 470, and a first cam surface is formed on an outer peripheral surface of the first cam wheel 471; a second cam wheel 472 is arranged at the second cam joint, and the second cam wheel 472 is eccentrically stacked on the first cam wheel 471 relative to the rotation axis of the rotating wheel set 470, and a second cam surface is formed on an outer peripheral surface of the second cam wheel 472.

The first conversion part 430 comprises a first sliding part 431 and a first conversion connecting part 450, and the first sliding part 431 comprises a first annular hole 432, and the first sliding part 431 is movably fitted with the first cam surface of the first cam wheel 471 by the first annular hole 432; the first conversion connecting part 450 is connected between the first sliding part 431 and the second end of the first clipping arm 410, so that a moving motion of the first sliding part 431 is converted into the reciprocating-swinging motion of the first clipping arm 410 around its swing axis by the first converting connecting part 450.

The second conversion part 440 comprises a second sliding part 441 and a second conversion connecting part 460 and a guiding structure 500. The second sliding part 441 comprises a second annular hole 442, and the second sliding part 441 is movably fitted with the second cam surface of the second cam wheel 472 by the second annular hole 442; the second conversion connecting part 460 is connected between the second sliding part 441 and the second end of the second clipping arm 420, so that a moving motion of the second sliding part 441 is converted into the reciprocating-swinging motion of the second clipping arm 420 around its swing axis by the second converting connecting part; the guiding structure 500 is configured to guide the first sliding part 431 and the second sliding part 441 to move respectively along a movement path perpendicular to the swing axis when the rotating wheel set 470 is rotating, and, at the same time, moving directions of the first sliding part 431 and the second sliding part 441 are opposite, so that the first end of the first clipping arm 410 and the first end of the second clipping arm 420 perform reciprocating-swinging motions in a manner of approaching or moving away from each other.

Figure 10:
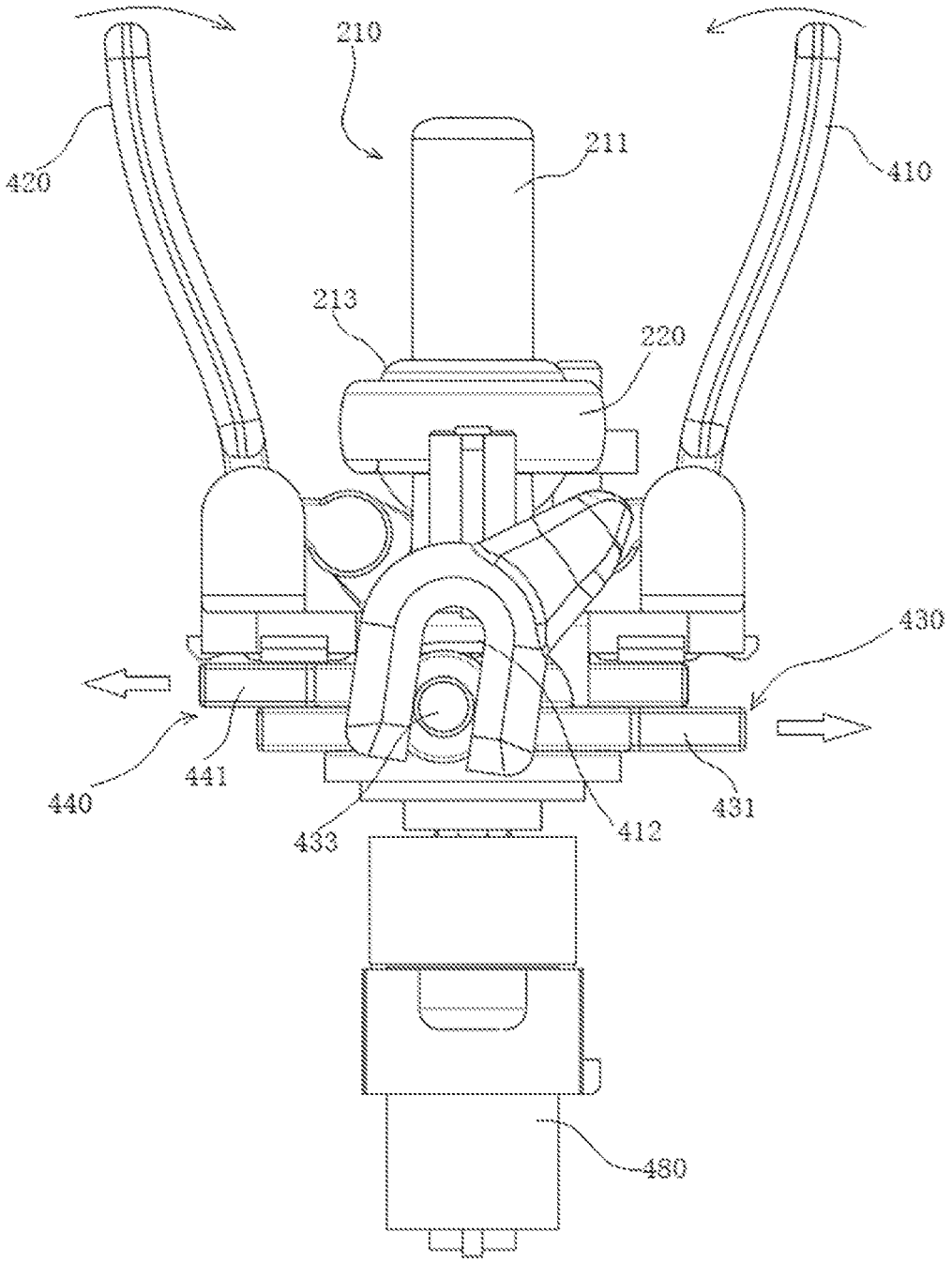
FIG. 10 is a front view of the massage drive mechanism provided by the embodiment of the present application.

As shown in FIGS. 8 to 10, the hole shapes of the first annular hole 432 and the second annular hole 442 are generally oval or waist-shaped. When the driving part 480 drives the rotating wheel set 470 to rotate, the first cam wheel 471 and the second cam wheel 472 of the rotating wheel set 470 are rotated together around the rotating axis. The first cam surface of the first cam wheel 471 is in rolling contact with the inner wall of the first annular hole 432 of the first sliding part 431, and the second cam surface of the second cam wheel 472 is in rolling contact with the second annular hole 442 of the second sliding part 441, so that the rotational force of the first cam wheel 471 and the rotational force of the second cam wheel 472 are respectively transmitted to the first sliding part 431 and the second sliding part 432. Under the guidance of the guiding structure 500, the first sliding part 431 and the second sliding part 441 respectively move along the movement paths perpendicular to the swing axis. Since the first cam wheel 471 and the second cam wheel 472 are offset stacked, the moving directions of the first sliding part 431 and the second sliding part 441 are opposite at the same time, and then the first switching part 430 and the second sliding part 441 move in opposite directions. Under the action of the second conversion part 440, the movements of the first sliding part 431 and the second sliding part 441 makes the first end of the first clamping arm 410 and the first end of the second clamping arm 420 perform a reciprocating-swinging motion in a manner of approaching or moving away from each other, respectively, and then respectively drive the opposite side walls of the bell-shaped cap 110 to perform pinching or kneading massage actions in a manner of approaching or moving away from each other.

As shown in FIGS. 8 and 9, the first cam wheel 471 of the rotating wheel set 470 in this embodiment is used as the first cam joint, and through the cooperation between the first annular hole 432 of the first cam wheel 471 and the first sliding part 431, the rotational motion of the first cam wheel 471 is converted into the moving motion of the first sliding part 431. The second cam wheel 472 of the rotating wheel set 470 is used as the second cam joint, and through the cooperation between the second annular hole 442 of the second cam wheel 472, the rotational motion of the second cam wheel 472 is converted into the moving motion of the second sliding part 432. It can be understood that the operation structure in which the first cam joint of the rotating wheel set 470 cooperates with the first sliding part 431 and the operation structure in which the second cam joint cooperates with the second sliding part 441 can be replaced by the corresponding movement mechanism and structural adjustment deformation. On the premise of not paying creative work, any movement mechanism replacement and structural adjustment deformation to achieve the same movement function are within the protection scope of the present application.

In addition, as shown in FIGS. 4 to 7, in this embodiment, the double cams on the top of the rotating wheel set 470 cooperate with the yoke-type first sliding part 431 and the second sliding part 441, so that two clipping arms can be driven by one driving part 40 to perform reciprocating-swinging massage action in a way of approaching or moving away from each other, that is, single drive can realize double swinging motion. The structure is simpler and more compact, the driving transmission mode is more stable and reliable, the overall weight of the massager is smaller, it is lighter, the assembly is more convenient, and the cost is lower.

In this embodiment, the first conversion connecting part 450 comprises a first shaft 433 and a first swing arm clamping slot, wherein the first shaft 433 is arranged on a left side of the first sliding part 431, and a central axis of the first shaft 433 extends parallel to the swing axis of the first clipping arm 410; the first swing arm clamping slot 412 is arranged at the second end of the first clipping arm 410, and the first swing arm clamping slot 412 is movably snapped on the first shaft 433.

The second conversion connecting part 460 comprises a second shaft 443 and a second swing arm clamping slot 422, wherein the second shaft 443 is arranged on a left side of the second sliding part 441, and a central axis of the second shaft 443 extends parallel to the swing axis of the second clipping arm 420; and the second swing arm clamping slot 422 is arranged at the second end of the second clipping arm 420, and the second swing arm clamping slot 422 is movably snapped on the second shaft 443.

As shown in FIGS. 5 to 10, when the driving part 480 drives the rotating wheel set 470 to rotate, the first cam wheel 471 and the second cam wheel 472 above the rotating wheel set 470 are respectively cooperated with the first sliding part 431 and the second sliding part 441, so that the first sliding part 431 and the second sliding part 441 move along the movement paths perpendicular to the swing axis respectively under the guidance of the guiding structure 500. At the same time, the moving directions of the first sliding part 431 and the second sliding part 441 are opposite, so that the first shaft 433 on the left side of the first sliding part 431 and the first swing arm clamping slot 412 at the second end of the first clipping arm 410 cooperates to push and pull the first clipping arm 410 to reciprocate around the swing axis. The second shaft 443 on the right side of the second sliding part 441 cooperates with the second swing arm clamping slot 422 at the second end of the second clipping arm 420 to push and pull the second clipping arm 420 to reciprocate around the swing axis. At the same moment, the swing direction of the first clipping arm 410 and the second clipping arm 420 are opposite. During the swinging process of the first clipping arm 410 and the second clipping arm 420, the rotation of the first swing arm clamping slot 412 and the second swing arm clamping slot 422 around the first shaft 433 and the second shaft 443 respectively, the first shaft 433 and the second shaft 443 also perform a sliding movement along the extending direction of the first swing arm clamping slot 412 and the second swing arm clamping slot 422 respectively. The design structure of the first swing arm clamping slot 412 and the second swing arm clamping slot 422 provides a movement gap for the sliding of the first shaft 433 and the second shaft 443, the structure is simpler and more compact, and the motion transmission mode is more stable and reliable. The assembly is more convenient and quicker, and the cost is lower.

Specifically, as shown in FIGS. 8 and 9, the first swing arm clamping slot 412 and the second swing arm clamping slot 422 are roughly fork-shaped, and the first swing arm clamping slot 412 is located on the left side of the second end of the first clipping arm 410 and the second swing arm clamping slot 422 is located on the right side of the second end of the first clipping arm 410. The first shaft 433 and the second shaft 443 pass through the openings of the left and right side walls of the fixing seat 510 respectively and are fitted and connected with the first swing arm clamping slot 412 and the second swing arm clamping slot 422, the first swing arm clamping slot 412 is parallel to the plane where the plate surface of the second swing arm clamping slot 422 is located, wherein the plane is perpendicular to the swing axis. In this way, the distance between the first swing arm clamping slot 412 and the second swing arm clamping slot 422 is larger. On the premise that the internal space of the massager is limited, the first sliding part 431 and the second sliding part 441 respectively drives the first swing arm clamping slot 412 and the second swing arm clamping slot 422 to reciprocate and swing, thereby leaving enough space for movement, so as to avoid malfunction due to interference contact due to movement.

As shown in FIGS. 8 to 10, the end of the first shaft 433 close to the first sliding part 431 has a first flange, and the end of the second shaft 443 close to the second sliding part 441 has a second flange, so that the first swing arm clamping slot 412 and the second swing arm clamping slot 422 are axially positioned by the first flange and the second flange respectively.

In this embodiment, as shown in FIGS. 5 to 9, the guiding structure 500 comprises a fixing seat 510, a first slider 434 and a second slider 444, wherein the fixing seat 510 extends along a direction perpendicular to the swing axis of the first clipping arm to form a guiding groove 511; the first slider 434 is arranged at an end of the first sliding part 431, and the first slider 434 is slidably arranged in the guiding groove 511, so as to guide the first sliding part 431 to move along a movement path perpendicular to the swing axis of the first clipping arm 410 by sliding the first slider 434 along an extending direction of the guiding groove 511; the second slider 444 is arranged at an end of the second sliding part 441, and the second slider 444 is slidably arranged in the guiding groove 511, so as to guide the second sliding part 441 to move along a movement path perpendicular to the swing axis of the second clipping arm 420 by sliding the second slider 444 along the extending direction of the guiding groove 511.

Specifically, as shown in FIGS. 5 to 9, the base 520 of the fixing seat 510 is divided into a cup holder and a cylindrical sleeve up and down, and both the cup holder and the cylindrical sleeve are hollow structures. The cylindrical sleeve is set on the upper end of the driving part 480, and the chamber of the cup holder is used to accommodate the driving component 401. Partial guiding grooves 511 are respectively extended and formed on the two side walls adjacent to the cup holder. Both ends of the first sliding part 431 are correspondingly provided with a first slider 434, and both ends of the second sliding part 441 are correspondingly provided with a second 444, so as to guide the first slider 434 and the second slider 444 to move along a moving path perpendicular to the swing axis by guiding groove 511. The guide groove 511 is a rectangular groove, the first slider 434 and the second slider 444 are strip-shaped, and the first sliding part 431 and the second sliding part 441 respectively are arranged in the guide groove 511 of the cup holder by the first slider 434 and the second slider 444 to play a guiding role.

In this embodiment, as shown in FIGS. 5 to 9, the surround pinch-kneading massager further comprises a surround massage component 200, the surround massage component 200 comprises: a motor, an eccentric wheel and a massage rod component, wherein the motor is arranged in the housing 100, and the housing 100 comprises an annular movement chamber 221; the eccentric wheel comprises a first portion and a second portion opposite to each other, the first portion of the eccentric wheel comprises a hinged ball head 216, and the hinged ball head 216 is arranged eccentrically with respect to a rotation axis of the eccentric wheel, the second portion of the eccentric wheel is drivingly connected with the motor, so that the eccentric wheel is driven to rotate by the motor, and a first end of the massage rod component extends outward from one end of the housing 100 to form a massage head 210, the bell-shaped cap 110 surrounds the massage head 210, and a second end of the massage rod component comprises a mouth part 215, the hinged ball head 216 can be movably fitted in the mouth part 215, and an outer peripheral surface of the massage bar component extends in a circumferential direction to form a protruding spherical surface 213, and the spherical surface 213 can be movably fitted in the annular movement chamber 221.

It should be noted that, as shown in FIG. 8, the eccentric wheel and the rotating wheel set 470 are stacked in combination, so that the driving part 480 drives the eccentric wheel and the rotating wheel set 470 to rotate together. Specifically, the eccentric wheel is drivingly connected with the driving part 480, so as to drive the eccentric wheel to rotate through the driving part 480, and the first cam wheel 471 of the rotating wheel set 470 is eccentrically stacked on the eccentric wheel relative to the rotation axis of the eccentric wheel. The second cam wheel 472 is eccentrically stacked a on the first cam wheel 471 relative to the rotation axis of the eccentric wheel. The hinged ball head 216 is eccentrically arranged on the second cam wheel 472 relative to the rotation axis of the eccentric wheel. In this way, the eccentric wheel and the rotating wheel set 470 can be driven to rotate together by using the driving part 480 of the motor.

Figure 6:
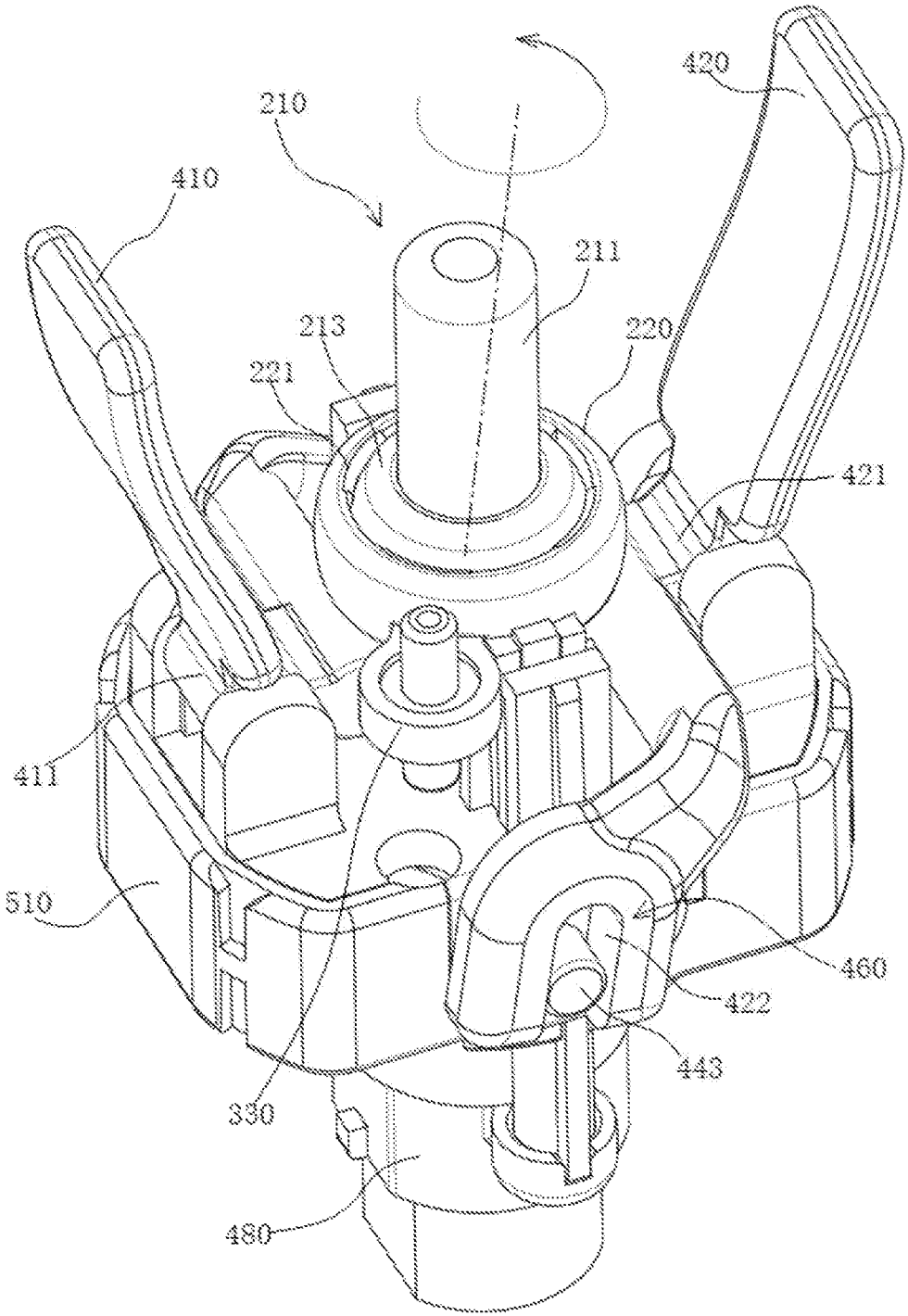
FIG. 6 is a structural schematic diagram of a massage drive mechanism provided by an embodiment of the present application at a second viewing angle.
Figure 7:
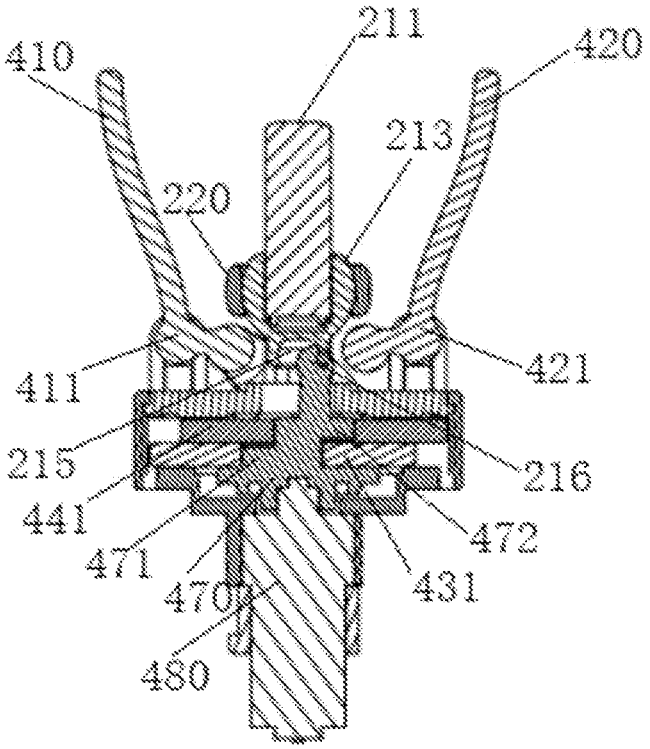
FIG. 7 is a sectional view of a massage drive mechanism provided by an embodiment of the present application.

As shown in FIG. 6, it can be seen that the surround massage component 200 drives the rotating wheel set 470 to rotate through the driving part 480 so that the hinged ball head 216 rotates around the rotation axis. As a result, the spherical surface 213 of the massage rod component is driven to rotate in the annular movement chamber 221, thereby driving the massage head 210 of the massage rod component to perform a 360-degree swinging movement around the center of the spherical surface 213 to produce a circular kneading massage action. Its structural design is simple and compact, the driving method is stable and reliable, and a variety of massage functions are cleverly combined, so that the massager can have both pinching massage and surround kneading massage, which further enriches the massage methods of the massager and expands the use of the massager. In this way, the needs of users are met, and the user experience is excellent.

Specifically, the housing 100 is provided with a bracket 220, the annular movement chamber 221 is arranged on the bracket 220, an inner peripheral surface of the annular movement chamber 221 extends along a circumferential direction to form a concave annular spherical surface and forms through openings at its upper and lower ends, so that the first end and the second end of the massage rod component respectively pass through the through openings at two ends of the annular movement chamber 221.

As shown in FIGS. 8 and 9, the upper cover 530 of the fixing seat 510 is covered on the cup holder, the upper cover 530 is provided with a pair of clamping slots 533 at intervals, the two sides of the bracket 220 are provided with a clamping block 222, and the bracket 220 is installed on the upper cover 530 by fitting the clamping block 222 with the clamping slot 533, and the middle part of the upper cover 530 is provided with a through hole, and the hinged ball head 216 passes through the through hole and fits with the mouth part 215 of the massage rod component.

The massager of this embodiment is applicable to the hand-held massager for massaging certain parts of the body, and some massage parts can be adaptively installed and fixed on the massage head 210 of the massage rod component according to massaging certain parts of the body, or the massage head 210 of the massage rod component is designed as a corresponding massage shape structure.

It should be noted that, as shown in FIG. 6, the diameter and shape of the annular spherical surface and the spherical surface 213 are adapted so that the spherical surface 213 and the annular movement chamber 221 are fitted with a ball hinge. A diameter of the annular spherical surface 213 is larger than a diameter of the spherical surface, and a height of the spherical surface along a axial direction is greater than a height of the annular spherical surface along the axial direction. In this way, when the driving part 480 drives the hinged ball head 216 to rotate around the rotational axis, the first end and the second end of the massage rod component can be driven to perform a swinging motion around the center of the spherical surface 213 at the same time, and the central axis of each part of the massage rod component is basically the same. When the hinged ball head 216 pushes the second end of the massage rod component to do a swinging motion around the center of the spherical surface 213, the spherical surface 213 of the massage rod component matches the annular spherical surface of the annular movement chamber 221, so that the first end of the massage rod component also performs a swinging movement around the center of the spherical surface 213 at the same time, so as to generate a surround kneading massage action.

Further, as shown in FIG. 3, the massage head 210 comprises a vibration motor 211 and a soft massage protrusion 212. An upper end of the spherical surface 213 extends axially to form an accommodating cavity 214, one end of the vibration motor 211 is accommodated in the accommodating cavity 214 to form a first end of the massage rod component, a lower end of the spherical surface 213 extends axially to form the second end of the massage rod component; and other end of the vibration motor is inserted into the soft massage protrusion 212, and the bell-shaped cap 110 surrounds the soft massaging protrusion 212 to form an integral structure, which can be integrally formed with silica gel or rubber, and the soft massage protrusion 212 is preferably formed into a tongue-shaped structure or a finger-shaped structure.

The massage head 210 is covered with a soft massage protrusion 212, the soft massage protrusion 212 covers and wraps the vibration motor 211, the soft massage protrusion 212 is soft and comfortable in contact with the human skin, so as to avoid the discomfort of human skin when the massage head 210 is in the surround kneading massage. In addition, the massage head 210 realizes the dual effects of surround kneading massage and vibration massage through the vibration motor 211, thereby enhancing the massage effect and improving the comfortable experience of massage, so as to meet the strong requirements of users for massage experience.

In this embodiment, as shown in FIGS. 3 and 8-9, the surround pinch-kneading massager further comprises an air suction component 300, the air suction component 300 comprises an air pump 310, the air pump 310 communicates with an inner chamber of the bell-shaped cap 110 through an air pipe, and the air pipe is provided with an airflow control valve 320. The bell-shaped cap 110 is connected with a pipe joint 330 through which the air pipe in the housing 100 communicates with the inner cavity of the bell-shaped cap 110. The pipe joint 330 is arranged on the bracket 220 for easy assembly. In this way, when the bell-shaped cap 110 is closely attached to the skin of the massaged part of the human body, the air in the bell-shaped cap 110 is drawn by the air pump 310, so that a negative pressure is formed in the bell-shaped cap 110 and is adsorbed on the massaged part of the human body. When a negative pressure is formed in the bell-shaped cap 110, the air flow is closed by the air flow control valve 320 to maintain the negative pressure environment. The air flow is opened through the airflow control valve 320 to release the pressure in the inner chamber of the bell-shaped cap 110, or the pressure is released by pinching the outer wall of the bell-shaped 110 with fingers. The airflow control valve 320 can be a solenoid valve or a one-way valve. When a negative pressure is formed in the bell-shaped cap 110 and is adsorbed on the massaged parts of the human body, the massage drive mechanism 400 drives the opposite side walls of the bell-shaped cap 110 to reciprocate and swing in a manner of approaching or moving away from each other, thereby performing pinch-kneading massage action on the massaged parts of the human body. The massage head 210 of the surround massage component performs a 360-degree swinging movement around the center of the spherical surface 213 to produce a circular kneading massage action. In this way, multiple massage methods are combined to further enhance the comfortable experience of massage, the structure design is compact, and the massage effect is better.

From the above description, it can be seen that the above-mentioned embodiments of the present application have achieved the following technical effects:

In the surround pinch-kneading massager of the present application, the surface of the housing 100 protrudes outward to form a soft bell-shaped cap 110, and the bell-shaped cap 110 fits closely with the massaged parts of the human body, the massage drive mechanism 400 in the housing 100 is respectively drivingly connected to the opposite side walls of the bell-shaped cap 110, so that the massage drive mechanism drives the opposite side walls of the bell-shaped cap 110 to reciprocate and swing close to or away from each other, so as to realize the pinch-kneading massage action on the massage parts of the human body. This enriches the massage methods of the massager, expands the range of use of the massager, and satisfies the diverse choices of users, thus enhancing the user experience.

The above description is the preferred implementation mode of the present application. It should be pointed out that for those of ordinary skill in the art, without departing from the principle of the application, some improvements and modifications can also be made, and these improvements and modifications are also regarded as the protection scope of the present application.

What is claimed is:

1. A surround pinch-kneading massager, comprising a housing, the housing comprises soft bell-shaped cap; and a massage drive mechanism, the massage drive mechanism comprises a first clipping arm, a second clipping arm and a driving component, a first end of the first clipping arm and a first end of the second clipping arm are respectively connected to two opposite side walls of the bell-shaped cap, the driving component is arranged in the housing, and the driving component is respectively drivingly connected to a second end of the first clipping arm and a second end of the second clipping arm, so that the first end of the first clipping arm and the first end of the second clipping arm are driven by the driving component to move toward or away from each other, so that the two opposite side walls of the bell-shaped cap produce a pinch-kneading massage action, wherein the first clipping arm is pivotally connected with the housing, and the second clipping arm is pivotally connected with the housing, so as to drive the first end of the first clipping arm and the first end of the second clipping arm to reciprocate and swing close to or away from each other by the driving component the driving component comprises:

a rotating wheel set, a rotating axis of the rotating wheel set is configured to be perpendicular to a swing axis of the first clipping arm, the swing axis of the first clipping arm is arranged parallel to the swing axis of the second clipping arm, and the rotating wheel set comprises a first cam joint and a second cam joint;

a driving part, the driving part is configured to drive the rotating wheel set to rotate;

a first conversion part, by a cooperation between the first conversion part and the first cam joint, a rotary motion of the rotating wheel set is converted into a reciprocating-swinging motion of the first clipping arm around its swing axis; and a second conversion part, by a cooperation between the second conversion part and the second cam joint, the rotary motion of the rotating wheel set is converted into a reciprocating-swinging motion of the second chipping arm around its swing axis, so that the second clipping arm and the first clipping arm perform reciprocating-swinging motion in a manner of approaching or moving away from each other the first cam joint comprises:

a first cam wheel, the first cam wheel is arranged eccentrically with respect to a rotation axis of the rotating wheel set, and a first cam surface is formed on an outer peripheral surface of the first cam wheel;

the second cam joint comprises:

a second cam wheel, the second cam wheel is eccentrically stacked on the first cam wheel relative to the rotation axis of the rotating wheel set, and a second cam surface is formed on an outer peripheral surface of the second cam wheel;

the first conversion part comprises:

a first sliding part, the first sliding part comprises a first annular hole, and the first sliding part is movably fitted with the first cam surface of the first cam wheel by the first annular hole; and a first conversion connecting part, the first conversion connecting part is connected between the first sliding part and the second end of the first clipping arm, so that a moving motion of the first sliding part is converted into the reciprocating-swinging motion of the first clipping arm around its swing axis by the first converting connecting part, the second conversion part comprise:

a second sliding part, the second sliding part comprises a second annular hole, and the second sliding part is movably fitted with the second cam surface of the second cam wheel by the second annular hole; and a second conversion connecting part, the second conversion connecting part is connected between the second sliding part and the second end of the second clipping arm, so that a moving motion of the second sliding part is converted into the reciprocating-swinging motion of the second clipping arm around its swing axis by the second converting connecting part; and a guiding structure, configured to guide the first sliding part and the second sliding part to move respectively along a movement path perpendicular to the swing axis by the guiding structure when the rotating wheel set is rotating, and, at the same time, moving directions of the first sliding part and the second sliding part are opposite, so that the first end of the first clipping arm and the first end of the second clipping arm perform reciprocating-swinging motions in a manner of approaching or moving away from each other;

wherein the first conversion connecting part comprises:

a first shaft, the first shaft is arranged on a left side of the first sliding part, and a central axis of the first shaft extends parallel io the swing axis of the first clipping arm; and a first swing arm clamping slot, the first swing arm clamping slot is arranged at the second end of the first clipping arm, and the first swing arm clamping slot is movably snapped on the first shaft;

the second conversion connecting part comprises:

a second shaft, the second shaft is arranged on a left side of the second sliding part, and a central axis of the second shaft extends parallel to the swing axis of the second clipping arm; and a second swing arm clamping slot, the second swing arm clamping slot is arranged at the second end of the second clipping arm, and the second swing arm clamping slot is movably snapped on the second shaft;

wherein the guiding structure comprises:

a fixing seat, the fixing seat extends along a direction perpendicular to the swing axis of the first clipping arm to form a guiding groove;

a first slider, the first slider is arranged at an end of the first sliding part, and the first slider is slidably arranged m the guiding groove, so as to guide the first sliding part to move along a movement path perpendicular to the swing axis of the first clipping arm by sliding the first slider along an extending direction of the guiding groove; and a second slider, the second slider is arranged at an end of the second sliding part, and the second slider is slidably arranged in the guiding groove, so as to guide the second sliding part to move along a movement path perpendicular to the swing axis of the second clipping arm by sliding the second slider along the extending direction of the guiding groove.

2. The surround pinch-kneading massager according to claim 1, wherein the bell-shaped cap protrudes outward from one end of the housing.

3. The surround pinch-kneading massager according to claim 1, wherein further comprising an air suction component, the air suction component comprises an air pump, the air pump communicates with an inner chamber of the bell-shaped cap through an air pipe, and the air pipe is provided with an airflow control valve.

4. The surround pinch-kneading massager according to claim 1, wherein the first end of the first clipping arm and the first end of the second clipping arm are respectively inserted into the opposite side walls of the bell-shaped cap, and the side walls of the bell-shaped cap substantially covers the first end of the first clipping arm and the first end of the second clipping arm.

5. The surround pinch-kneading massager according to claim 1, wherein further comprising a surround massage component, the surround massage component comprises:

a motor, the motor is arranged in the housing, and the housing comprises an annular movement chamber;

an eccentric wheel, the eccentric wheel comprises a first portion and a second portion opposite to each other, the first portion of the eccentric wheel comprises a hinged ball head, and the hinged ball head is arranged eccentrically with respect to a rotation axis of the eccentric wheel, the second portion of the eccentric wheel is drivingly connected with the motor, so that the eccentric wheel is driven to rotate by the motor; and a massage rod component, a first end of the massage rod component extends outward from one end of the housing to form a massage head, the bell-shaped cap surrounds the massage head, and a second end of the massage rod component comprises a mouth part, the hinged ball head can be movably fitted in the mouth part, and an outer peripheral surface of the massage bar component extends in a circumferential direction to form a protruding spherical surface, and the spherical surface can be movably fitted in the annular movement chamber.

6. The surround pinch-kneading massager according to claim 5, wherein the housing is provided with a bracket, the annular movement chamber is arranged on the bracket, an inner peripheral surface of the annular movement chamber extends along a circumferential direction to form a concave annular spherical surface and forms through openings at its upper and lower ends, so that the first end and the second end of the massage rod component respectively pass through the through openings at two ends of the annular movement chamber.

7. The surround pinch-kneading massager according to claim 6, wherein a diameter of the annular spherical surface is larger than a diameter of the spherical surface, and a height of the spherical surface along a axial direction is greater than a height of the annular spherical surface along the axial direction.

8. The surround pinch-kneading massager according to claim 5, wherein the massage head is covered with a soft massage protrusion, and the bell-shaped cap surrounds the soft massaging protrusion to form an integral structure.

9. The surround pinch-kneading massager according to claim 8, wherein a vibration motor is arranged in the soft massage protrusion.

10. The surround pinch-kneading massager according to claim 9, wherein an upper end of the spherical surface extends axially to form an accommodating cavity; one end of the vibration motor is accommodated in the accommodating cavity, and other end of the vibration motor is inserted into the soft massage protrusion, and the soft massage protrusion basically covers the other end of the vibration motor.

11. The surround pinch-kneading massager according to claim 8, wherein the soft massage protrusion is formed into a tongue-shaped structure or a finger-shaped structure.

* * * * *